US005669736A

United States Patent [19]

Lin

[11] Patent Number: 5,669,736

[45] Date of Patent: Sep. 23, 1997

[54] MULTI-LEVEL SUPPORT CAST FOUNDATION RESIST PILE

[76] Inventor: Chien-Hsin Lin, 2800 State St., Santa Barbara, Calif. 93105

[21] Appl. No.: 556,702

[22] Filed: Nov. 13, 1995

[51] Int. Cl.[6] ..... E02D 5/44

[52] U.S. Cl. ..... 405/233; 405/232; 405/237

[58] Field of Search ..... 405/233, 237, 405/232, 244, 240–243, 239, 229

[56] References Cited

U.S. PATENT DOCUMENTS 3,975,917 8/1976 Asayama ..... 61/53

5,304,016 4/1994 Kishiwada ..... 5/46

*Primary Examiner*—Dennis L. Taylor

[57] ABSTRACT

The present invention is a cast-in-place foundation resist pile with substantially lateral extensions inexpensively formed before or after the cement has been poured into the pile hole excavation. In addition, the present invention preferably makes those lateral extensions of the foundation pile into at least one of the levels of soft soil where the pile hole excavation has been made in alternating levels or zones of relatively soft and hard soils.

5 Claims, 3 Drawing Sheets

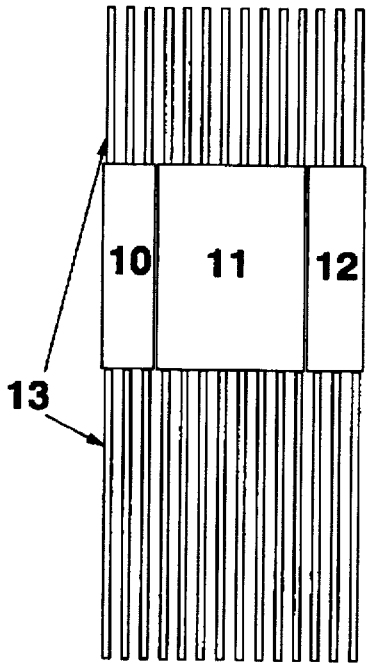
Figure 6
Figure 7
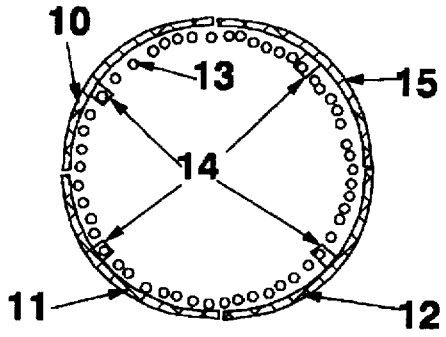
Figure 8
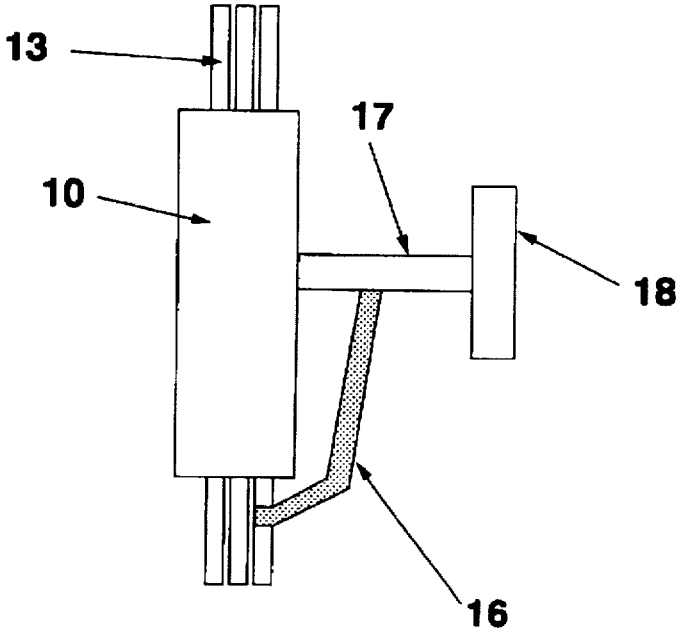

MULTI-LEVEL SUPPORT CAST FOUNDATION RESIST PILE

BACKGROUND OF THE INVENTION

The present invention relates to foundation piles, especially cast-in-place type. The present invention more particularly relates to foundation piles with lateral extensions developed to more fully stabilize the pile in soft earth or in alternating layers of soft and hard earth.

The use of driven or cast-in-place foundation piles to stabilize above ground structures is well known in the art of reinforced concrete structures. Many types of structures in are secured to the earth in this manner. Buildings and structures which must be built on soft or potentially shifting soils are the best candidates for foundation piles, wherein the structures are as diverse and high rise office buildings and offshore oil platforms. Although the prior art has been aware of the necessity for making special adaptation for the soils and the foundation piles to more firmly place the foundation piles, the prior art has not well established an inexpensive method for providing lateral extensions of a foundation pile to take advantage of existing soil hardness to enhance a firm placement.

A well known prior art cast-in-place foundation pile is shown in FIG. 1. This foundation pile is known as a Gow caisson pile. As shown in FIG. 1, the Gow caisson pile is formed after special excavation is made in the bottom of the pile hole. The lateral parts of the conical shape excavation are made in relatively softer soil than the soil under the base of the excavation. This pile type is used to create a narrow diameter section through an upper part of the softer soil to then form a broad "foot" or lateral extension for support on the harder soil underneath. No special compaction of the walls of softer soil is made since the purpose of the support structure is its ability to transmit forces to the harder soil underneath the "foot".

A second well know prior an cast-in-place foundation pile is shown in FIG. 2 and FIG. 3. This adaptation of the pedestal pile is made in the following manner. As shown in FIG. 2, the excavated pile hole is partially filled with flowable cement and an impact driving post which sealingly engages the sides of the pile hole is positioned above the flowable cement. The post is then driven into the flowable cement and the flowable cement expands into the softer soil, as shown in FIG. 3, to form a spherical shaped foundation pedestal in the softer soil. This adaptation of the pedestal pile is an improvement in cost since no special excavation must be done and the expansion of the flowable cement into the sober soil provides compaction of the softer soil around the spherical pedestal. The disadvantage of this structure is that its spherical nature cannot effectively transmit to the harder soil underneath the lateral motion forces of the structure above it. In fact, the spherical pedestal will be more prone to rotation by action of lateral forces on the above ground structure than would an unenhanced foundation pile.

Prior art devices have attempted to combine these advantages of soil compression and lateral extension of the pile in several ways. U.S. Pat. No. 3,975,917 describes a series of undulating lateral extensions in a pre-cast foundation pile to be driven into soft soils alone, wherein the soft soils are described as sand, gravel, etc. The act of driving such a pile into soft soils does not in itself have a beneficial effect in soft soils. The advantage of the patent can only be achieved by driving the piles sufficiently close together ". . . so that the filler filled into adjacent piles are rigidly and compactly tamped together, and thereby a strong, rigid, compactly pressed zone of foundation can be reliably established, not only in the shallow portion but over a wider region."(col. 2, 11. 59–64). The patent does not teach use of the device in hard soils.

The extent to which the prior art has recently comprehended enhancement of cast-in-place foundations relating to alternating horizontal levels of soil types in the pile hole excavation is shown in U.S. Pat. No. 5,304,016. In that patent, the rotational speed of a rotating shaft is changed to enhance mixing of flowable cement with the soil as the rotating shaft digs downward. It was found that the efficiency of mixing cement with different soil types was improved by alternating the timing of the mixing step. The improved mixing resulted in a better mixed earth/cement foundation pile.

So in addition to soil compression and lateral extension of the pile, another factor has been indicated by the prior as being potentially advantageous in enhancing foundation piles. That new factor is the recognition that alternating zones of soil types might be encountered in excavation of a foundation pile hole and that special adaptation of the method of making a cylindrical foundation file could be contemplated to make a stronger foundation pile.

There is clearly a need to provide a single invention that could simultaneously and effectively take advantage of soil compression, lateral extension of the foundation pile, and alternating levels of soil type in foundation pile excavation.

SUMMARY OF THE INVENTION

The present invention is a cast-in-place foundation pile with substantially lateral extensions inexpensively formed before or after the cement has been poured into the pile hole excavation. In addition, the present invention preferably makes those lateral extensions of the foundation pile into at least one of the levels of soft soil where the pile hole excavation has been made in alternating levels or zones of relatively soft and hard soils.

In the present invention, a collar of releasable, vertically segmented segments is preferably attached by breakable springs to the cage of reinforcing steel to placed in a cylindrical foundation pile hole excavation. The collar is made preferably of segments vertically wide enough to approximately equal the depth of a level or zone of soft soil found to exist in the soils of the foundation pile hole excavation. The collar is positioned on the cage of reinforcing steel so that when the cage in placed in the foundation pile hole excavation, the collar is located so that its lower edge is approximately level with a transition in the foundation pile hole excavation of soil type from hard to soft soil, wherein the hard soil is located below the lower edge of the collar. The preferable embodiment of making the collar segments as vertically wide as the soft soil section limit alternate embodiments of the present invention only to those widths. It will be apparent to those skilled in the an that the objects of the present invention will still be achieved although the collar segments are not so wide as the soft soil section.

When the collar is appropriately located on the cage of reinforcing steel (or its equivalent structure) adjacent to a soft soil section, a radially applied force drives the segments of the collar substantially horizontally into the soft soil section. The radially applied force may be provided before the cement is poured by driving a pointed shaft axially into the foundation pile hole excavation and the cage of reinforcing steel, such that force transmission means providing contact between the back side of the collar segments and the pointed shaft transform the downward force into a lateral, substantially horizontal force sufficient to drive the collar segment into the soft soil section. The radially applied force may also be provided after the cement is poured into the foundation pile hole excavation by sealingly impacting the top of the flowable cement surface with sufficient force such that, as described above for the embodiment of the pedestal foundation pile in the prior an, the hydrostatic force is transmitted from the surface of the flowable cement axially to the soft soil section. However, not disclosed by the prior art, the collar segments of the present invention are driven substantially horizontally and prevent the formation of the spherical lateral extension seen in the use of the prior art pedestal foundation pile. It will be preferably in the present invention to apply the radial force to the collar segments after pouring of concrete where it is expected that the soft soil section (s) would be too soft to maintain their lateral excavation or compaction without the hydrostatic force of the flowable cement being applied at the same time as the lateral expansion of the collar segments.

The present invention provides an inexpensive and precise means of driving a fiat plate into a soft soil section adjacent to the cage of reinforcing steel, such that when the flowable cement is allowed to flow into that soft soil section behind the driven-in collar section, a well-defined (as opposed to a spherical) lateral extension is formed. Preferably the underside of the lateral extension rests on a hard soil section, thereby providing a "foot" or lateral extension of support obtaining the advantages of the Gow caisson pile, but dramatically improving on them by providing lateral soft soil compaction in the process of forming the lateral extension.

The advantages of lateral soil compression in establishing additional support for foundation piles are thus obtained for soft soils without dependence on the closeness of spacing of the piles, as required to obtain the advantages in U.S. Pat. No. 3,957,917. Lateral soil compression into the soft soil according to the present invention extends the force transmission ability of the lateral extension of the foundation pile for lateral forces imposed on the above ground structure. The compaction zone of the soft soil at the vertical, outside face of the driven-in collar segment is preferably in contact with the harder soil located beneath the compaction zone, thereby extending the "foot" or lateral extension of support provided by lateral extensions according to the present invention.

Another preferable embodiment of the present invention includes evaluation of soil samples and use of a reverse circulation drill for excavation of the shaft. This special drilling device and procedure allows excavation in soft soils. A concurrent insertion of pipe with the diameter of the shaft prevents the soft soil from filling the shaft as the shaft is excavated. Flowable cement preferably fills the shaft as it is excavated. Thus removal of the drill will leave the shaft wall support pipe and cement in the shaft. It will be preferable to then insert the cage of reinforcing steel with the collar or collars. The shaft wall support pipe will have had sections cut from it to form openings that align with the soft soil sections when the pipe is inserted into the shaft. The pipe openings will be slightly larger than but will have the same general shape as the collar sections to be driven into the soft soil sections. Collar sections mounted on the cage of reinforcing steel will be situated so each section aligns with a pipe opening when the cage is inserted into the concrete-filled shaft. The collar sections will be aligned to sufficiently fill or block each pipe opening so that later application of the driving hydrostatic pressure for the collar sections forces the collar sections through the pipe openings into the soft soil sections as described above.

The provision of a shaft support pipe with pipe openings efficiently directs the driving hydrostatic force substantially completely against the collar sections instead of against the harder soil sections. The section of the shaft with harder soils are protected from the expansion of the compressed flowable concrete by the shaft support pipe. Thus the use of the shaft support pipe with pipe openings in the present invention results in longer and more sharply defined concrete lateral projections into the softer soil sections. Alternately, the collar sections might be attached by releasable springs or similar breakable attachment to the shaft support pipe itself to cover the pipe openings. After insertion of the cage of reinforcing steel (without collar sections) into the flowable concrete-filled shaft, the driving hydrostatic force is applied which will break the collar section attachments to the shaft support pipe and drive the collar sections into the soft soil sections.

BRIEF DESCRIPTION OF THE DRAWINGS

FIG. 6 is a vertical orientation of collar segments of a single collar and reinforcing steel cage according to the present invention.

FIG. 7 is a horizontal cross section of collar segments of a single collar and reinforcing steel cage according to the present invention.

FIG. 8 is a collar segment according to the present invention in relation with the cage of reinforcing steel with axial force transmission means attached to the backside of the collar segment and support means for the same in connection with the cage of reinforcing steel.

DETAILED DESCRIPTION OF THE INVENTION

For the present invention, it is essential that core sampling of the soil where the shaft will be excavated be analyzed for soil types and compaction. Although lateral extensions of the central shaft are useful for enhancing support in many types of soils, application of the present invention is especially useful in softer soils such as sand and soft clay. The core sample will require driving a hollow cylinder or equivalent device parallel to the force of gravity into the earth where the pile is to be located. Additional samples should be taken in a radius of a few feet beyond the radius of the pile so that the soil properties will be determined for the soil into which the lateral extensions from the central shaft will be forced. The soil sampling device should then be open in a manner preventing the disruption of the layers of soil sampled. The soil layers should be measured and analyzed for soil types and compaction.

Figure 1:
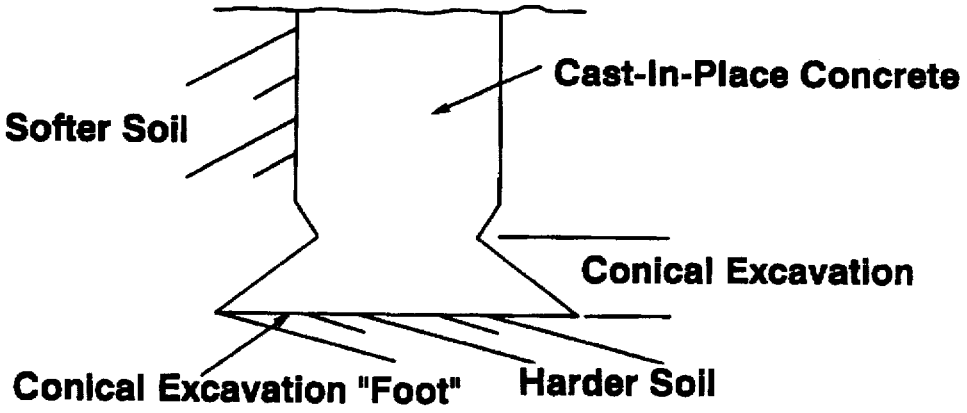
FIG. 1 is a cross section of a prior art Gow caisson pile.
Figure 2:
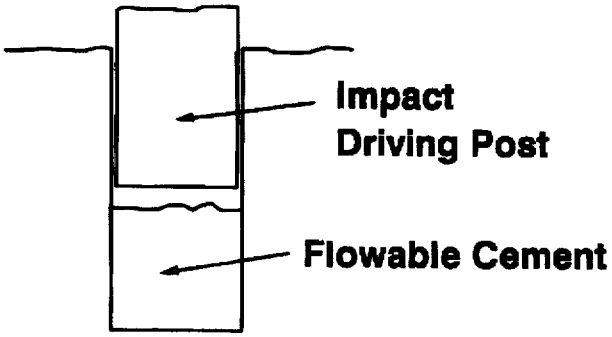
FIG. 2 is a cross section of a foundation pile hole excavation partially filled with flowably cement prior to formation of an adapted pedestal pile.
Figure 3:
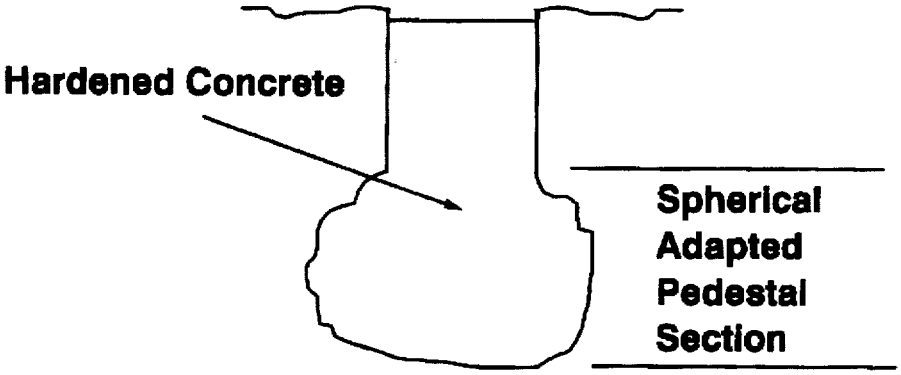
FIG. 3 is a cross section of the complete adapted pedestal pile wherein the flowable cement has been expanded into soft soil section at the bottom of the foundation pile hole excavation to form a spherical pedestal.
Figure 4:
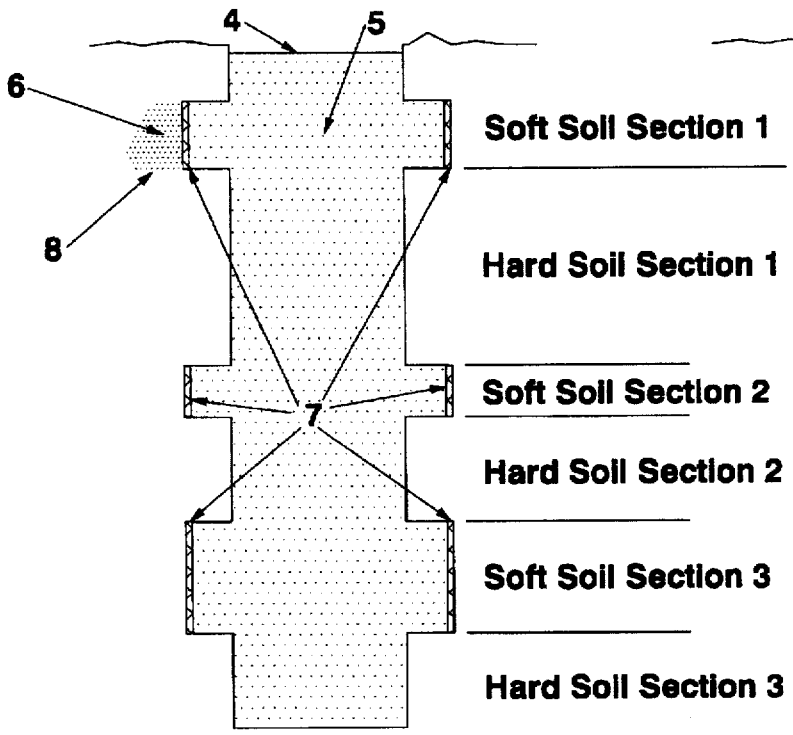
FIG. 4 is a vertical cross section of a foundation pile with lateral extensions according to the present invention without beneficial upper lateral excavation edge sloping.

The present invention will now be discussed with reference to FIG. 4. As described above, the present invention uses an axially applied force to drive a plate horizontally into a level of zone of relatively softer soil and then the excavated portion is backfilled with cement that forms a lateral extension of the foundation pile. In FIG. 4, foundation pile 5 with top surface 4 exhibits 6 lateral extensions behind (distally toward the axis of foundation pile 5) collar plates 7. The number of lateral extensions made in Soft Soil Sections 1, 2, and 3, alternatingly supported on Hard Soil Sections 1, 2, and 3, may be as few as 2. A compressed soil zone 6 is shown as illustrative of the compression of soft soil (sand, gravel, liquifiable clay, soft clay, etc. as used herein) at the front face of each of the collar plates 7. The compressed soil zone 6 will vary in size and degree of compression depending on the nature of the soft and hard soils, but the underside contact surface 8 of compressed soil zone 6 advantageously extends the force transmission properties of each of the lateral extensions of foundation pile 5.

Figure 4A:
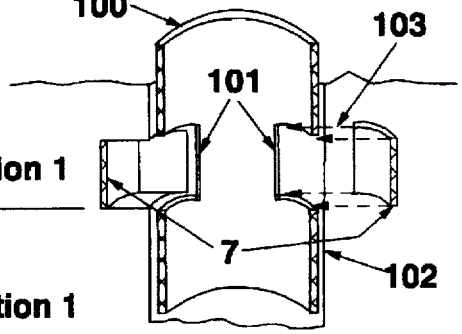
FIG. 4*a* is a vertical cross section of a shalt support pipe in a shaft excavated with a reverse circulation drill and orientation of collar sections relating to its use in the present invention.

The present invention will now be described with reference to FIG. 4*a*. As described above, another preferable embodiment of the present invention includes use of a reverse circulation drill for excavation of the shaft 102. FIG. 4*a* is a drawing of a shaft excavated by a reverse circulation drill, with the drilling apparatus removed, but with shaft support pipe 100 in place to support the shaft 102. Shaft support pipe 100 is to be understood from FIG. 4*a* to be a continuous pipe from the top of shaft 102 to the bottom of the shaft shown in FIGS. 4 and 5, although shaft support pipe 100 is shown in a cutaway view without the full cylindrical surface being visible. Pipe openings 102 are exemplary of the pipe openings for each of the collar plates 7 to be provided in shaft support pipe 100 for the passage of the collar plates from attachment to the cage of reinforcing steel (not shown in this FIG. 4*a*) into the adjacent soft soil section. The collar plate 7 at the left of shaft support pipe 100 is shown having been driven into Soft Soil Section 1 after being pushed through the pipe opening 101 at the left of shaft support pipe 100. The flowable concrete shown by the fill of FIG. 4 is not shown in FIG. 4*a* so that the orientation of the shaft support pipe 100, pipe opening 101 and collar plate 7 can be shown with respect to the lateral extension of shaft 102 made by that collar plate 7.

FIG. 4*a* also shows a collar plate 7 to the fight of shaft support pipe 100. That collar plate is shown in relation to alignment lines 103, so that the path of the collar plate 7 through the pipe opening 101 will be apparent. Alignment lines 103 show how a collar plate 7 would fit through or be releasably attached to the shaft support pipe 100.

Figure 5:
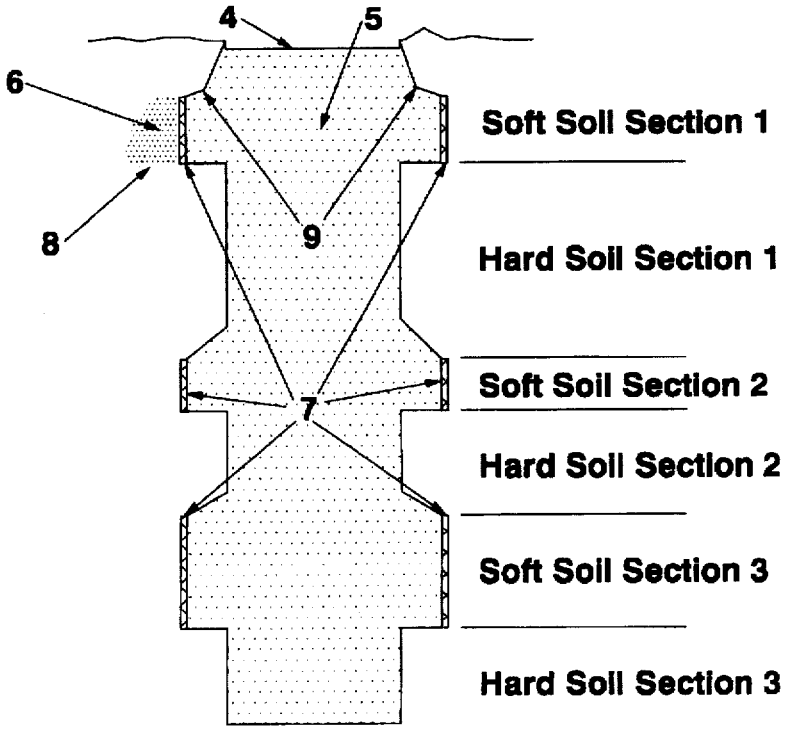
FIG. 5 is a vertical cross section of a foundation pile with lateral extensions according to the present invention with beneficial upper lateral excavation edge sloping.

An alternate embodiment of the present invention is shown in FIG. 5. Although substantially similar to the embodiment of FIG. 4 (whose identification of aspects use the same numbers as shown in FIG. 4), the embodiment of FIG. 5 shows a vertical cross section of foundation pile 5 with lateral extensions showing upper lateral excavation edge sloping 9. In softer soils, the action of driving one of collar plates 7 horizontally into the soft soil can cause the upper edge of the lateral excavation caused thereby to fall into the flowable cement or into the empty downwardly cylindrical excavation made for foundation pile 5. The falling away of that upper edge of the lateral excavation to form upper lateral excavation edge sloping 9 eliminates the sharp edge transition from the main body of the foundation pile 5, which main body is in the downwardly cylindrical excavation, to the lateral extension and thus improves the resistance to fracture of a lateral extension from the main body of foundation pile 5.

FIG. 6 shows a single set of collar plates 10, 11, and 12 arranged on a section of the cage of reinforcing steel 13. The collar plates 10, 11, and 12 are shown in a horizontal view as cylindrical wall segments attached to a cylindrical cage of reinforcing steel. An arrangement collar segments can be equally advantageous situated around a square or polygonally cross section cage of reinforcing steel. As may be inferred from the location of the lateral extensions of foundation pile 5 into the Soft Soil Sections 1, 2, and 3, the vertical location of a collar of collar plates 10, 11, and 12 on a vertical cage of reinforcing steel 13 will be determined by soil sampling and analysis typical of that required for foundation setting preparation. The soft and hard soil sections depth and location will be determined, and, according to the present invention, the sets of collar plates can then be easily manufactured from cylindrical steel pipe sections when the cage of reinforcing steel is cylindrical, as shown in FIG. 7, or they may be made from flat steel plates is the cage of reinforcing steel is cross sectionally square or polygonal.

FIG. 7 shows the spring attachments 14 connecting the collar plates 10, 11, 12, and 15 to the cage of reinforcing steel 13. The spring attachments 14 may be comprised of springs, wires or other breakable material releasably attached to the collar plates and at least a single vertical member of the cage of reinforcing steel 13. The spring attachments 14 are strong enough to support the weight of the collar plates 10, 11, 12, and 15 when the cage of reinforcing steel 13 is inserted into the cylindrical excavation made for the foundation pile 5, but also weak enough to break upon experiencing radial, hydrostatic force necessary to drive the collar plates 10, 11, 12 and 15 laterally into a soft soil section.

The number of collar plates shown in FIG. 7 is four, and the arcuate portion of the horizontal cross section of the cylindrical cage of reinforcing steel 13 that they cover is about 90 degrees. This is a preferred embodiment shown in FIG. 7 and is not limiting of the number of collar plates that may be used in a single collar to be arranged vertically on the cage of reinforcing steel 13. As few as one collar plate might be used to accomplish the objects of the present invention. The arcuate portion of the horizontal cross section of the cylindrical cage of reinforcing steel 13 that a collar section might cover and still achieve the objects of the present invention is from about 10 degrees to about 180 degrees. Although the collar plates 10, 11, 12 and 15 are shown wherein their vertical edges are in close proximity with each other, it is within the objects of the present invention that the vertical edges of the collar plates might overlap, and, upon being driven laterally outward by a radial force, result in a set of lateral extensions of the foundation pile that appear V-shaped.

FIG. 8 is a generalized drawing of a collar plate 10 vertically secured to the cage of reinforcing steel 13, but also having a force transmission extension attached to the back (inward) face of the collar plate 10 and supported by a support means. This embodiment of a collar plate permits translation of a force imparted by a tapered shaft directed axially downward relative to the main body of the foundation pile such that when first a narrow diameter bottom end of the tapered shaft slidably contacts the portion of force transmission extension distal to the back face of the collar plate, the downward axial force is translated to an outward radial force, forcing the front face of the collar plate into the soft soil section.

The following is another embodiment of the method of making a foundation pile according to the present invention. An excavation for the main vertical body of the foundation pile is made and the soil levels determined as described above. Collars formed of collar plates are vertically arranged at the outside periphery of a cage of reinforcing steel (or the like) as described above for the collar plates of FIG. 7. The structure of a cage of reinforcing steel with attached collar(s) of reinforcing plates is inserted into the excavation for the main body of the foundation pile. In one embodiment, cement is poured into the excavation so that its level in the excavation is above the level of the collar arranged vertically highest on the cage of reinforcing steel. An impact post similar to that described in the prior an for expanding the flowable cement for the adapted pedestal pile is sealingly engaged at the upper flowable cement surface. The impact post is then driven with sufficient force to transmit hydrostatic force from the head to the impact post through the flowable cement to the collar plates, forcing them into the soft soil sections to which they are adjacent.

In another embodiment, a shaft tapered at one end (shaft not shown) is driven into the axis of the inserted cage of reinforcing steel. The collar plates have been adapted as shown in FIG. 8 so that the force transmission extensions extend radially toward the axis of the cage of reinforcing steel. When the tapered shaft slidably contacts the force transmission extensions, the collar plates are driven into the soft soil sections. The tapered shaft is then removed and the excavation for the main vertical body of the foundation shaft and the lateral excavations formed by driving the collar plates into the soft soil sections are then filled with cement. Collar plate 10 has attached to its inside (facing the axis of the central shaft) a driving shaft 17 and tapered shaft contact means 18. Driving shaft 17 is supported by support means 16 so that the downward motion of a tapered shaft will translate the downward motion to lateral force in the direction of the driving shaft 17.

I claim:

1. A process for forming a cast-in-place foundation pile comprising:

(a) an excavation for a central shaft of the foundation pile wherein vertical sampling is made of soil of the excavation for determining a first soil zone and a second soil zone immediately adjacent to the central shaft, the soil in the first soil zone being substantially softer than the soil in the second soil zone and the second soil zone is located immediately below the first soil zone;

(b) support means for collar plates and vertically disposed collar plates on the support means, vertically locating collar plates on the support means so that after insertion of the support means in the excavation, the collar plates will be situated adjacent to the first soil section;

(c) inserting support means into the excavation; and (d) radial force means driving the collar plates substantially horizontally into the adjacent soil to form lateral extensions of the central shaft.

2. The process of claim 1 wherein the radial force means comprise flowing a flowable cement mixture into said excavations and sealingly impacting the surface of the pool of flowable cement.

3. The process of claim. 2 wherein the radial force means further comprise a shaft support pipe with pipe openings vertically and horizontally aligned to accommodate the passage of the collar plates from their support means to the adjacent soil to form the lateral extensions of the central shaft.

4. The process of claim 3 wherein the shaft support pipe prevents substantial expansion of the central shaft after application of sealing impact on the surface of the pool of flowable cement.

5. The process of claim 2 wherein the force of the impact on the surface of the pool of flowable cement is sufficient to transmit radial force to the collar plates to drive the collar plates into the adjacent soil.

* * * * *